US005727612A

United States Patent [19]

Oksakowski

[11] Patent Number: 5,727,612

[45] Date of Patent: Mar. 17, 1998

[54] FOLDING BLIND ROD

[76] Inventor: Udo Oksakowski, Zollgasse 15, A-6850 Dornbirn, Austria

[21] Appl. No.: 775,925

[22] Filed: Jan. 2, 1997

[30] Foreign Application Priority Data

Jan. 2, 1996 [AT] Austria ..... A 2196

[51] Int. Cl.[6] ..... E06B 9/06

[52] U.S. Cl. ..... 160/84.01; 160/264

[58] Field of Search ..... 160/84.01, 84.04, 160/84.06, 264, 330, 348

[56] References Cited

U.S. PATENT DOCUMENTS 4,545,611 10/1985 Broadbent ..... 160/84.01 X
5,072,767 12/1991 Kraeutler ..... 160/84.04
5,176,388 1/1993 Horton ..... 160/84.04
5,273,096 12/1993 Thomsen et al. ..... 160/84.01

*Primary Examiner*—David M. Purol
*Attorney, Agent, or Firm*—Friedrich Kueffner

[57] ABSTRACT

A folding blind rod for a folding blind to be arranged in hose-like, horizontally extending webs of a folding blind, wherein the folding blind rod has several separating points, particularly intended breaking points, provided along the length of the folding blind rod. A tongue-like extension is integrally connected to one end of the folding blind rod. The tongue-like extension has a pin extending transversely of the axis of the folding blind rod. A bore each having an axis extending transversely of the axis of the folding blind rod is provided laterally of each separating point and also at the other end of the folding blind rod. The cross-sections of the bores and pins are constructed so as to correspond to each other.

14 Claims, 2 Drawing Sheets

FOLDING BLIND ROD

BACKGROUND OF THE INVENTION

1. Field of the Invention

The present invention relates to a rod for a folding blind to be arranged in hose-like, horizontally extending webs of a folding blind.

2. Description of the Related Art

Folding blinds or shades to be used at windows are known in the art. Such folding blinds are composed of a material web which extends over the height and width of the window. This material web is with its upper edge secured in the lintel area of the window. As a rule, horizontally extending, hose-like ribbons which extend over the width of the folding blind are arranged with equal vertical spacings on the side facing the window. These ribbons may be components which are manufactured separately, preferably on ribbon weaving machines, which are subsequently sewn to the material web. However, it is also possible to place the material web at the aforementioned vertical spacings into hose-like folds and to sew the folds together. These hose-like horizontal ribbons or folds serve to receive the folding blind rods which extend over the width of the folding blind. Pull strings for raising and lowering the folding blind are provided at least at the vertical edges of the folding blind. When pulling up the folding blind, the material web is folded into horizontal folds whose size depends on the vertical distances between two successive folding blind rods.

Metal rails, preferably of aluminum, or rods of synthetic material are used as folding blind rods. Since the folding blinds have very different widths, the metal rails must be cut to length to correspond to the width of the folding blind. These metal rails are available for sale as long rod material, so that cutting the rods to the required size results in substantial material cuttings and, thus, in waste.

The rods of synthetic material, which usually have a smaller cross section than the metal rails, are manufactured as endless rails and wound onto a reel. They are pulled from the reel by the desired length and then cut. However, the means available in a household are not sufficient for completely reversing the curvature predetermined by the reel, so that these rails turn out curved which negatively affects the appearance of the folding blind.

SUMMARY OF THE INVENTION

Therefore, starting from the prior art discussed above, it is the primary object of the present invention to avoid the disadvantages mentioned above and to propose a folding blind rod which can be sold in lengths which can be easily manipulated, which is straight and which can be adjusted to any desired and required length practically without waste and without requiring special tools.

In accordance with the present invention, the folding blind rod has several separating points, particularly intended breaking points, provided along the length of the folding blind rod. A tongue-like extension is integrally connected to one end of the folding blind rod. The tongue-like extension has a pin extending transversely of the axis of the folding blind rod. A bore each having an axis extending transversely of the axis of the folding blind rod is provided laterally of each separating point and also at the other end of the folding blind rod. The cross-sections of the bores and pins are constructed so as to correspond to each other.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 5:
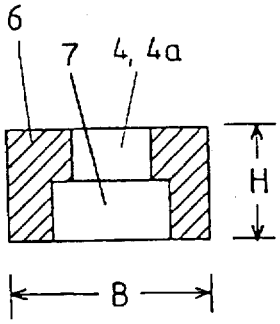
FIG. 5 is a sectional view, on a larger scale, taken along sectional line V—V in FIG. 3.

The folding blind rod 1 shown in FIGS. 1–4, preferably manufactured of synthetic material, has a length L of, for example, 250 mm. As seen over its length, the single-piece folding blind rod 1 has several sections A preferably of equal length, for example, 50 mm, as shown in the illustrated embodiment. As seen in FIG. 5, the cross-sectional dimensions B×H of the folding blind rod 1 are about 10×6 mm.

A tongue-like extension 2 is integrally formed at one end of the folding blind rod 1. A pin 3 extending transversely of the axis of the folding blind rod 1 is provided on the extension 2. The sections A which make up the individual folding blind rod 1, are predetermined by the distances between bores 4 which correspond with respect to size and cross-sectional shape to the pin 3. A separating point 5, particularly a predetermined breaking point is formed adjacent the bores 4 located between the pin 3 and the bore 40 at the other end of the folding blind rod 1. The bores 4 are located on that side of the respectively adjacent separating point 5 on which the tongue-like extension 2 is arranged. As further illustrated in FIG. 5, the bores 4, 40 are located in the bottom 6 of grooves 7 whose cross-section corresponds to that of tongue-like extension 2. The shapes and dimensions of pins 3 and bores 4 and 40 are adapted to each other in such a way that they form a clamping seat when they are joined together, as will be explained in more detail below.

Figure 6:
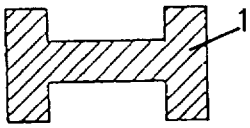
FIG. 6 is a cross sectional view, also on a larger scale, taken along sectional line VI—VI of FIG. 3.

The tongue-like extension 2 with the pin 3, and the bottom 6 of the groove 7 with the bores 4, 40 each have a thickness s which corresponds to half the height h of the folding blind rod 1. In relation to the height h of the folding blind rod 1, the extension 2 and the bottom 6 of the groove 7 are arranged offset relative to each other. The separating points 5 divide the folding blind rod 1 into several sections, preferably of equal length. Except for the areas with the bores 4 or 40, the individual sections have an I-shaped cross-section, as indicated in FIG. 6, however, this cross-sectional shape is not a binding requirement for the present invention. The separating points 5 are formed by incisions in the flanges of the I-shaped cross section.

The cross-sectional shape of the illustrated embodiment provides the highest possible stability with the smallest possible use of material.

Figures 1, 2, 3, 4:
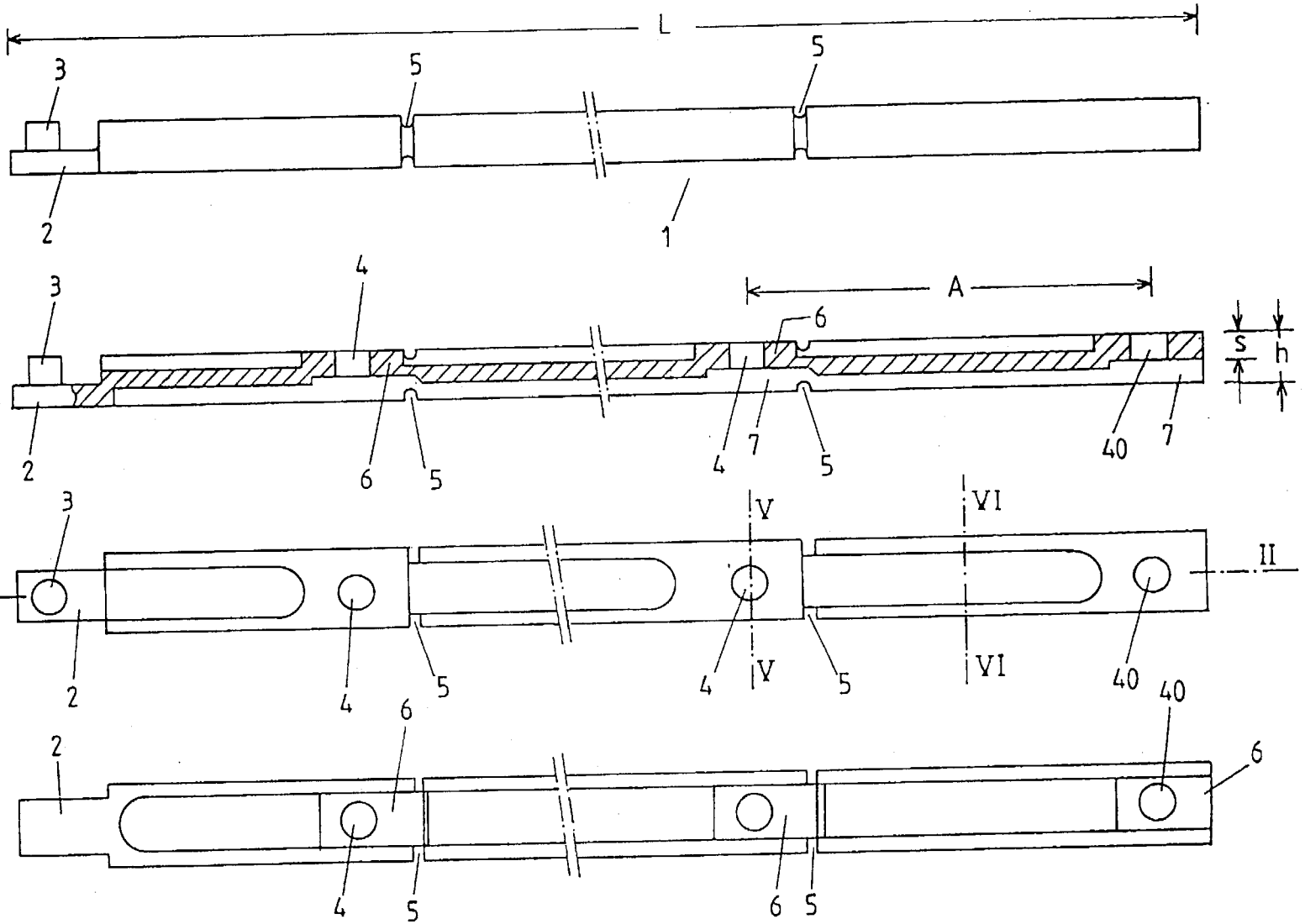
FIG. 1 is an elevational view of the folding blind rod according to the present invention.
FIG. 2 is a longitudinal sectional view taken along sectional line II—II in FIG. 3.
FIG. 3 is a top view of the folding blind rod.
FIG. 4 is a bottom view of the folding blind rod.
Figure 8:
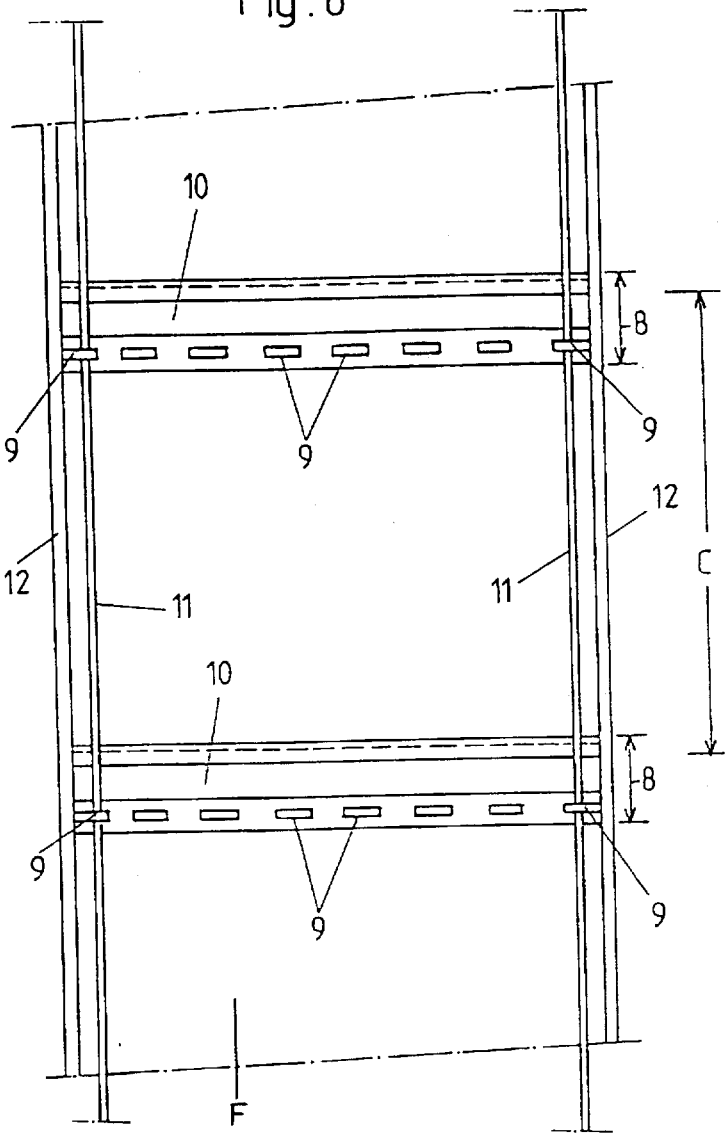
FIG. 8 is rear view, also on a smaller scale, of the folding blind.
Figure 7:
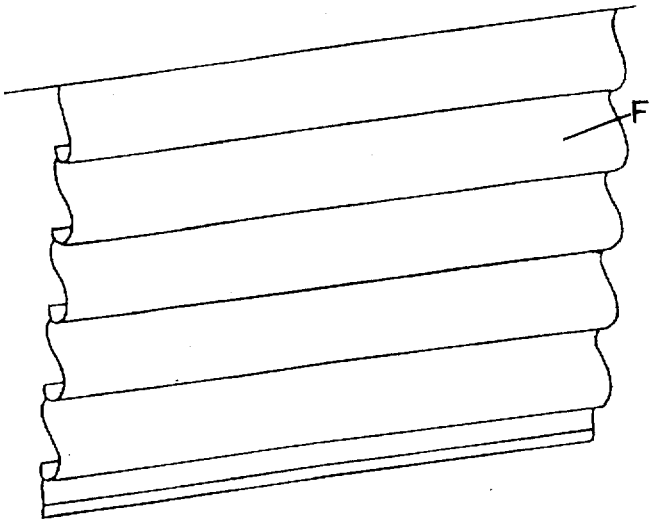
FIG. 7 is a front view, on a smaller scale than in FIGS. 1–4, showing a partially pulled-up folding blind.

FIG. 8 of the drawing shows a folding blind from the rear. Hose-like, horizontal ribbons 8 are sewn to the blind at equal vertical spacings C. As is also conventional in so-called curtain valances, a row of eyes 9 are provided in the lower portion of each horizontal ribbon 8. The hose-like middle portion 10 serves to receive the folding blind rod 1. Pull strings 11 are inserted through the eyes 9 at each end. The hose-like ribbons 8 manufactured on ribbon machines may be fastened to the material web of the folding blind with their upper or lower edges. The row of eyes 9 may also be located above the hose-like portion 10, or underneath the portion 10, as shown in FIG. 8. A partially pulled-up folding blind F is shown in FIG. 7.

The folding blind rod according to FIGS. 1–4 is manufactured with a length L of, for example, 250 mm and the individual sections a have a length of 50 mm. If the folding blind to be provided with folding blind rods has a width, for example, of 1800 mm, seven folding blind rods 1 are required for each ribbon 8, which corresponds to a length of 1750 mm. These seven individual folding blind rods 1 are coupled to each other by means of the pins 3 and the bore 40 at the end of each folding blind rod 1. The extension 2 with the pin 3 is now separated from another folding blind rod 1 by pinching, cutting, striking or sawing, and is coupled to the folding blind rods which have already been joined together. This is effected by pressing the pin 3 of the extension 2 of this individual piece into the bore 40 of the last folding blind rod. The bores 4, 40 and the pins 3 as well as the groove 7 and the tongue-like extension are manufactured with respect to their cross-sectional shape and dimensions within very narrow tolerances, so that a clamping connection is effected with a sufficiently great stability. The seven folding blind rods according to FIGS. 1–4 discussed above and the additional partial piece now together form a folding blind rod with a length of 1800 mm.

In the example described above, the width of the folding blind was an integral multiple of 50 mm. Folding blinds having a width which is not an integral multiple of 50 mm are also conceivable. The maximum deviation which must be accepted in such a case is 40 mm. This deviation has no practical significance because this dimension is compensated by the trims 12 at the edges of the folding blind.

A folding blind must be equipped with a plurality of folding blind rods. Independently of the respective width of the folding blind and also independently of the number of folding blind rods to be provided for each folding blind, the maximum length of the residue from a folding blind rod is 200, which is a dimension which is practically insignificant.

The invention is not limited by the embodiments described above which are presented as examples only but can be modified in various ways within the scope of protection defined by the appended patent claims.

I claim:

1. A folding blind rod adapted for arrangement in hose-like horizontally extending ribbons of a folding blind, the folding blind rod comprising a plurality of separating points provided along the folding blind rod, the folding blind rod having a first end and a second end, a tongue-like extension integrally formed at the first end of the folding blind rod, the tongue-like extension having a pin extending transversely of an axis of the folding blind rod, a bore each having an axis extending transversely of the axis of the folding blind rod being provided adjacent each separating point and adjacent the second end of the folding blind rod, wherein each bore and pin has a cross-section constructed so as to correspond to each other.

2. The folding blind rod according to claim 1, wherein the separating points are intended breaking points.

3. The folding blind rod according to claim 1, wherein the folding blind rod has a groove with a groove bottom, each bore being located in the groove bottom, wherein a cross section of the groove corresponds to a cross section of the tongue-like extension.

4. The folding blind rod according to claim 3, wherein the folding blind rod has a height and the tongue-like extension with the pin and the groove bottom of the groove with the bore each have a thickness which corresponds to half the height of the folding blind rod, and wherein the tongue-like extension and the groove bottom are arranged offset relative to each other in relation to the height of the folding blind rod.

5. The folding blind rod according to claim 3, wherein the grooves with the bores are located adjacent each separating point on a side facing the first end of the folding blind rod.

6. The folding blind rod according to claim 1, wherein the separating points are arranged so as to divide the folding rod blind into several sections.

7. The folding blind rod according to claim 6, wherein the sections are of equal length.

8. The folding blind rod according to claim 6, wherein the sections formed by the separating points have a length of several centimeters.

9. The folding blind rod according to claim 8, wherein the sections have a length of 5 cm.

10. The folding blind rod according to claim 6, wherein, except for portions with the bores, the sections have a I-shaped cross section.

11. The folding blind rod according to claim 10, wherein the separating points are incisions in flanges of the I-shaped cross section.

12. The folding blind rod according to claim 1, wherein the folding blind rod has cross-sectional dimensions of about 10×6 mm.

13. The folding blind rod according to claim 3, wherein the pins and bores as well as the grooves and extensions have dimensions adapted to each other so as to form a clamping seat.

14. The folding blind rod according to claim 1, wherein the pin on the tongue-like extension has an axial length corresponding at most to a thickness of the groove bottom or of the extension.

* * * * *